United States Patent [19]

Paterson et al.

[11] 4,057,909

[45] Nov. 15, 1977

[54] CONTINUOUS DRYING HOODS

[75] Inventors: Malcolm M. Paterson, Atkinson, N.H.; John S. DiMercurio, Medford; Albert H. Mooradian, Winchester, both of Mass.

[73] Assignee: Raytheon Company, Lexington, Mass.

[21] Appl. No.: 658,136

[22] Filed: Feb. 13, 1976

[51] Int. Cl.[2] ..... F26B 21/00

[52] U.S. Cl. ..... 34/76; 34/168; 34/217

[58] Field of Search ..... 34/57 R, 57 A, 77, 78, 34/168, 171, 169, 216, 217; 98/115 VM

[56] References Cited

U.S. PATENT DOCUMENTS

| | | | |
|---|---|---|---|
| 2,627,669 | 2/1953 | Candor | 34/76 |
| 3,186,106 | 6/1965 | Cobb et al. | 34/77 |
| 3,209,467 | 10/1965 | Taylor, Jr. | 34/216 |
| 3,257,739 | 6/1966 | Wentz | 34/216 |
| 3,745,670 | 7/1973 | Hartwig | 34/217 |

*Primary Examiner*—John J. Camby
*Assistant Examiner*—Larry I. Schwartz
*Attorney, Agent, or Firm*—H. A. Murphy; J. D. Pannone; J. T. Meaney

[57] ABSTRACT

A material collecting device such as a hopper, shredder, or enclosed conveyor having an entrance opening for deposit of material into the device, an exit opening for removal of material, and a hood on the device connected with duct means for exhaust of dust particles from the material, the hood being provided with a circumferential passage through which air is drawn into the device for entraining such dust particles, and with coils or rings for removing moisture from the air, the coils being connected with a source of hot fluid or refrigerant for drying the material and/or the air within the device, and being Coanda-shaped if desired for extraction of water from a moving air stream.

11 Claims, 4 Drawing Figures

FIG. 2
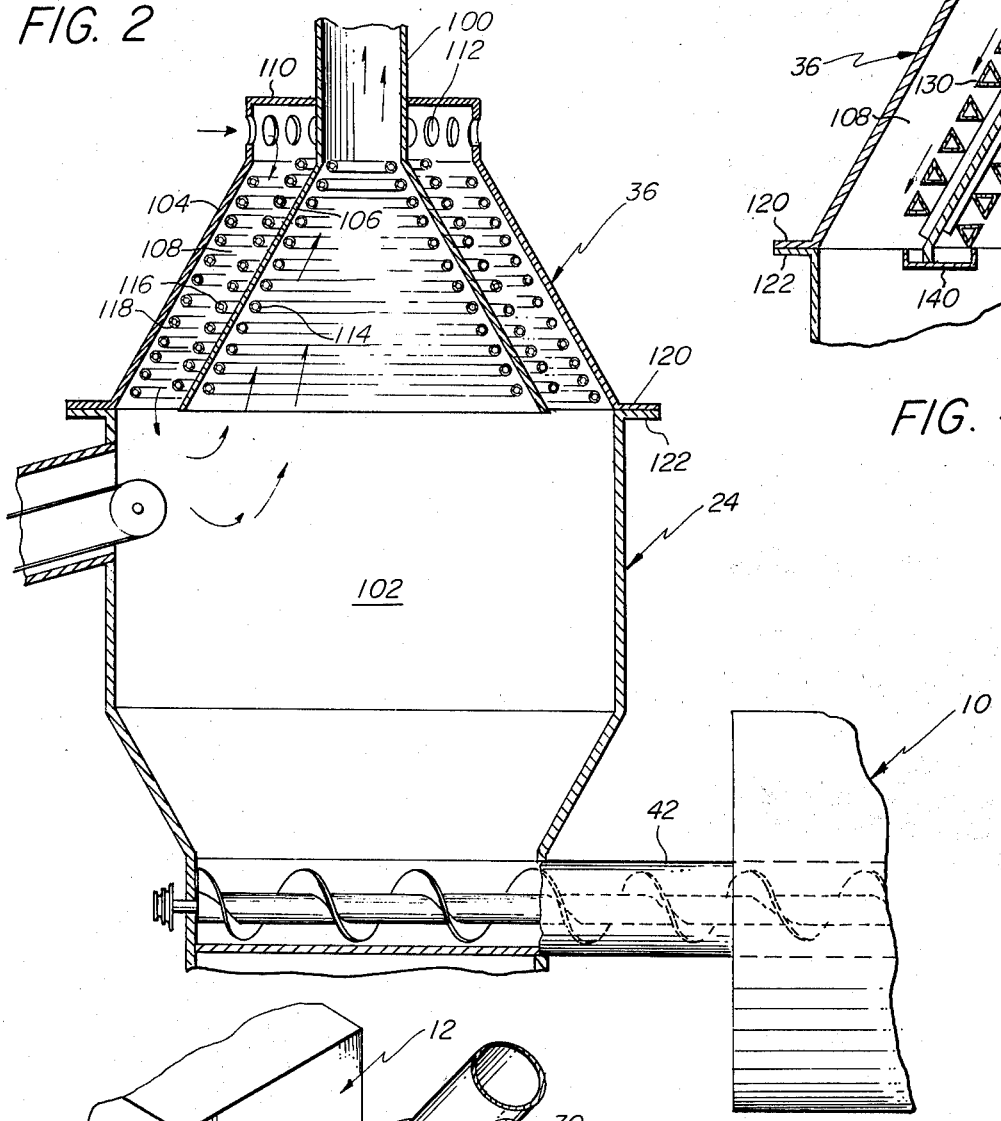
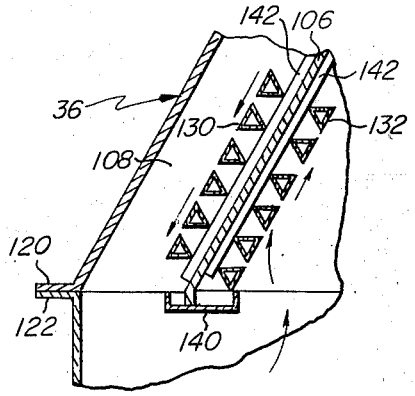
FIG. 4
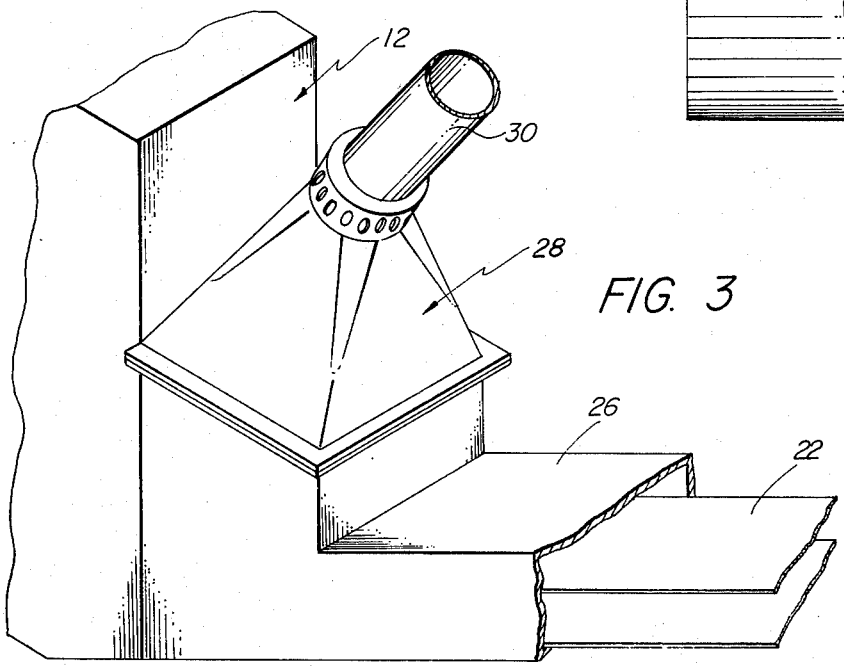
FIG. 3

CONTINUOUS DRYING HOODS

BACKGROUND OF THE INVENTION

In material handling or processing systems it is often necessary to provide a device such as a hopper, shredder, conveyor, or the like which receives the material for storage or processing and eventually transfers it, either in the same or a modified form, to additional apparatus. During the process of depositing the material in the device small light particles of the material become readily easily separated from large heavies particles and may be skimmed off in a stream of air which passes through the device at relatively high velocity. Such skim classification is fully described in copending U.S. application Ser. No. 604,576, filed Aug. 14, 1975, now abandoned and assigned to the same assignee as the present application.

It has been found, however, that light particles of the material often become embedded within agglomerations or clumps of material due to the fact that the material contains substantial amounts of moisture, causing components of the material to adhere together in agglomerations or masses containing both light and heavy materials.

It has also been found that sometimes the air stream being used for the skim classification contains undesirable amounts of moisture which may be added to the materials in the device, creating undesirable problems such as odor, cohesion of particles of materials to one another, or difficulty in removing materials from the device.

SUMMARY OF THE INVENTION

In accordance with this invention there is provided a skim classification system wherein the storage or processing devices are provided with means for drying materials within the devices and means for drying also the air entering the devices. This is achieved by providing such drying means within the hoods which enclose the upper ends of or are otherwise associated with the devices, which drying means may include heat-radiating steam or hot water coils, Coanda elements, or refrigerant coils. Thus, by removing moisture from material being stored or processed within the devices a substantial amount of the agglomerations or clumps are broken up to allow more efficient skimming of light particles, and by removing moisture from the air entering the devices such moisture is prevented from accumulating on the materials in the devices and causing the formation of agglomerations.

BRIEF DESCRIPTION OF THE DRAWINGS

The above and other objects and advantages of this invention will become apparent from the following description taken in connection with the accompanying drawings, wherein:

FIG. 2 is a vertical sectional view through a hooded storage device embodying the invention;

FIG. 3 is a partial isometric view of a shredder-conveyor combination having a hooded drying device associated therewith; and FIG. 4 is an enlarged fragmentary sectional view of a hood showing Coanda drying elements therein.

DESCRIPTION OF THE PREFERRED EMBODIMENTS

Figure 1:
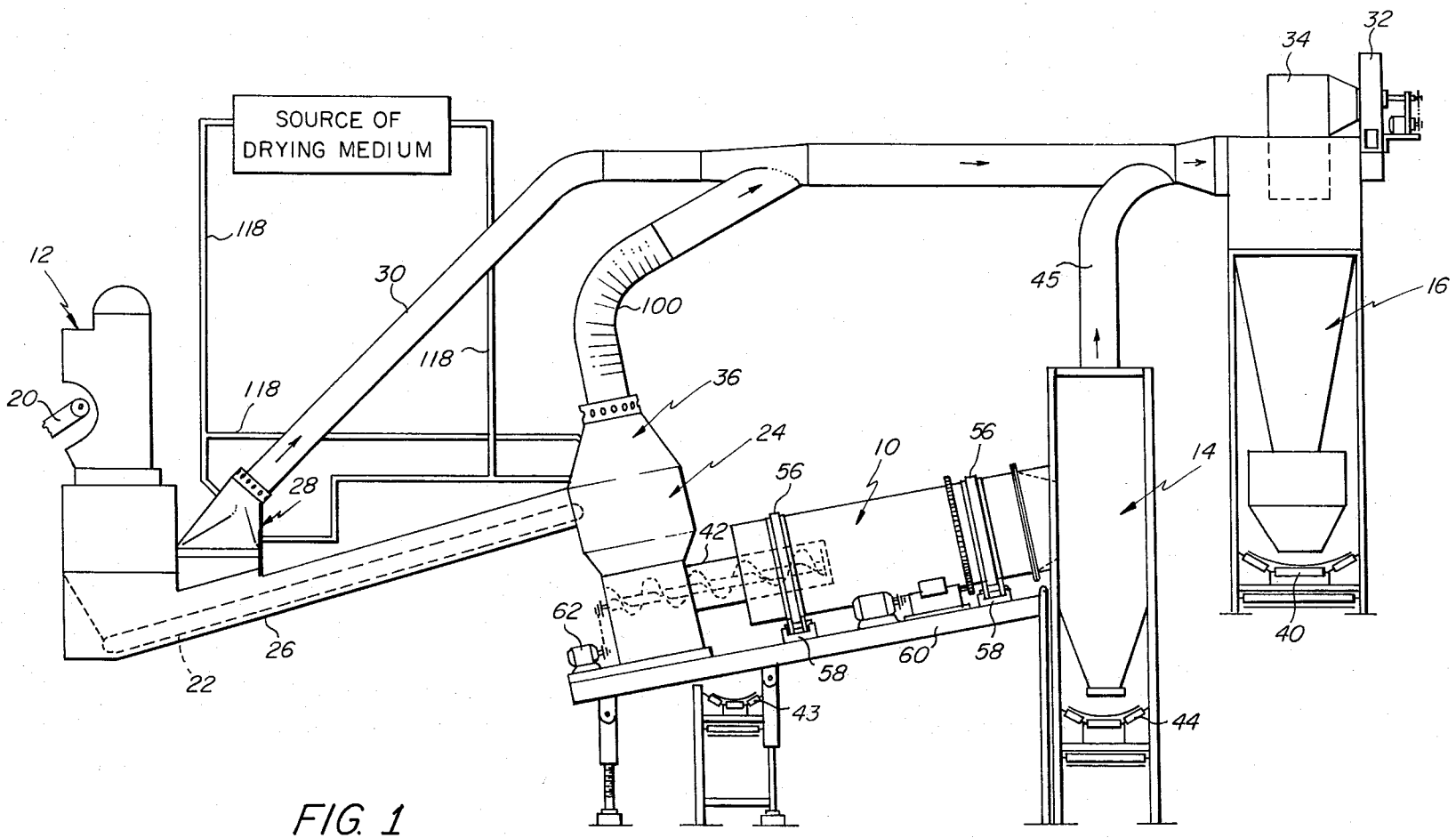
FIG. 1 is a schematic diagram of a materials separation system embodying the invention.

Referring more particularly to the drawings wherein like characters of reference designate like parts throughout the several views, there is shown in FIG. 1 a waste separation apparatus which includes, as a primary light and heavy materials separator, a rotary drum classifier 10 into which is fed a supply of mixed materials of various sizes, shapes and weights. The materials are first shredded in a shredder 12 to reduce the components of the materials to a predetermined maximum size. The rotary drum 10 functions to receive the shredded materials and separate the light materials from the heavy materials, and the light materials are thereafter separated into light and heavy fractions by a suitable plenum chamber 14, with the light fractions being subsequently deposited in a cyclone collector 16.

One system for performing such separation of waste materials is shown and described in U.S. patent application Ser. No. 580,273 now abandoned which is assigned to the same assignee as the present invention. Therefore, for details not disclosed herein, reference should be made to that application.

The shredder 12 receives raw waste materials by means of a suitable conveyor 20 and these materials are completely diversified including metals, wood, plastics, cloths, papers, garbage, etc. in various uncontrolled quantities and sizes. The shredder 12 is a standard well known piece of equipment such as shredder Model No. 7100 sold by Williams Patent Crusher & Pulverizer Co. of St. Louis, Missouri, for example, and reduces the sizes of the components of the supply of waste therein to not greater than a predetermined size such as from 1 to 12 inches, for example.

The shredded materials fall to the bottom of the shredder onto a belt conveyor 22 which carries them to a feed hopper 24 located adjacent one end of the rotary drum 10.

The components of the water deposited on the conveyor are varied, as pointed out above, not only as to types of materials but also as to size and to degree of dryness. Specifically, the supply of waste includes very light particles or dust which may be combustible. This is particularly true at a location immediately after the shredding process. Since the presently described system is intended in part to separate combustibles from the remaining waste for subsequent use as fuel, it is highly desirable that these light combustible particles not be allowed to escape. Furthermore, injection of such materials into the atmosphere surrounding the apparatus can also create undesirable pollution such as might be harmful to persons positioned in the area around the apparatus.

Accordingly, the conveyor 22 is substantially completely enclosed by a duct 26 which extends between the shredder 22 and feed hopper 24 to prevent escape of the particles into the ambient atmosphere.

Further, in accordance with this invention an attempt is made to remove such particles from the waste immediately after the waste passes through the shredder. This is done by locating a collecting hood 28 immediately above the duct 26 at the end thereof which is connected to the shredder 12. The hood 28 is connected by suitable ducts or conduits 30 to cyclone collector 16. Air at high velocity is forced through the shredder 12, hood 28, and ducts 30 into the cyclone collector 16 by means of a fan or blower 32. The blower 32 is mounted in any suitable fixed location and is operatively connected to the adjacent end of the exhaust duct 30 at the upper end of the cyclone collector 16 and is operated by a motor 34 through suitable driving means so as to rotate in a manner which will suction air into the exhaust duct 30 out of the shredder 12 and duct 26 through hood 28. Thus the light combustible particles in the duct 26 become entrained in the high velocity air flow and are subsequently deposited in the cyclone collector 60, thereby performing a preliminary or skim classification.

It will be apparent that all of the light particles emanating from the shredder 12 may not be completely withdrawn by this preliminary skim classification process. Therefore, a second skim classification may be performed elsewhere such as at the feed hopper 24 as the mixed waste materials from conveyor 22 are dropped into the feed hopper 24. To achieve this second preliminary skim classification the feed hopper 24 is provided with a hood 36 which is connected at one end to an exhaust duct 30. Thus, as material is being deposited in feed hopper 24 by conveyor 22 a high velocity air stream is created within the feed hopper 24 and duct 38 by fan 32 so that light particles remaining in the waste material will be entrained within the high velocity air stream in the feed hopper 24 and duct 38 and will eventually be drawn into the cyclone collector 16 along with the particles from the shredder 12 and duct 26.

The particles collected in the cyclone collector 16 will drop into the bottom of the collector and will eventually be deposited onto a suitable conveyor 40 for transferral to a suitable storage area for eventual use as a fuel.

The material in the feed hopper 24 is forced out of the hopper by a screw feed device 42 as fully described in the aforementioned U.S. application Ser. No. 580,273. The screw feed device 42 deposits the mixed materials within the rotary air drum classifier 10 which separates the raw materials into light and heavy materials in the known fashion of devices of this character. The drum 10 is angled at a selected inclination, such as 10° for example, and air is caused to flow through it at high velocity by fan 32, as will be described. As raw materials drop from the end of the screw feed device 42 onto the bottom of the drum wall, the heavy materials will be rotated upwardly by vanes within the drum to a point where they will fall to a lower point within the inclined drum. This action is repeated until eventually the heavy materials fall out of the lower end of the drum onto a conveyor 43 which will carry them away for further processing or disposal.

The light materials will be entrained within a high velocity air stream and will be carried out the upper end of the drum 10 and into the plenum chamber 14. In the plenum chamber 14 these light materials are further separated into light and medium fractions by controlling the velocity of the air stream passing through the chamber 14. The air stream from the drum 10 enters the plenum chamber 20 at a point in the lower regions thereof and exits at the top. Thus, by controlling the size of the chamber and the velocity of the air rising within it the heavier of the materials entering the chamber are permitted to fall by gravity to the bottom of the chamber for removal by suitable means such as a conveyor 44 for eventual reprocessing or disposal such as by incineration or other means.

The lighter fractions will continue to be entrained within the air stream and will be carried into the cyclone collector 16 through a duct 45 when fan 32 is operated. Such light fractions may serve many purposes and have been found particularly suitable for use as a fuel. They are removed from the cyclone collector preferably by a screw feed (not shown) to a conveyor 40 which will then carry them to a selected supply or disposal area.

As pointed out in the aforementioned U.S. application, the rotary drum 10 is rotated about its longitudinal axis by means of a motor 52 and gear arrangement 54, the drum being supported by suitable circumferential flanges 56 which engage roller supports 58 mounted on a platform 60 which is adapted to be moved up and down about an axis at its end adjacent the phenum chamber 14 whereby control of the ratio of light to heavies being separated within the drum is achieved. Operation of the screw feed portion of the device 42 may be accomplished by motor 62. Operating means for the conveyors 20 and 22 are not shown or described herein but may comprise any suitable and convenient conventional means.

It has been found that the system described above is adequate for skimming off light particles which tend to freely float in the air within the hoods 28 and 36 or which lightly adhere to the surfaces of objects included in the materials being processed. However, it has also been found that at times the materials contain substantial amounts of moisture which causes light and heavy materials to adhere together in clumps or agglomerations from which light particles cannot easily be removed. Such moisture may comprise a part of the waste materials themselves or may be introduced to the materials in the air stream which is intended to perform the skimming operation.

Therefore, the present invention includes means for removing moisture from either the materials or from the incoming air. This is achieved by providing drying means in one or both of the collector hoods 28 and 36.

As seen best in FIG. 2, the hood 36 is shown as mounted on the upper end of the hopper 24 and has an exhaust duct 100 connected to it in such a manner that air within the hopper and hood may be drawn upwardly into the duct by the aforementioned fan 32. It is to be understood, however, that in accordance with this invention the hood may be mounted on any other type of material storage or processing chamber which receives and discharges material as required, such as a shredder, storage tank, plenum, conveyor, or the like. Material to be stored or processed enters one side of the device near its upper end by means of conveyor 22 and proceeds to fall toward the bottom of the chamber 102 from which it is subsequently removed on demand by means of the screw conveyor 42. As the material drops off the end of the conveyor, small particles become separated from the mass of material and much of this particle matter becomes suspended in the air within the chamber 102 and hood 36.

However, in accordance with this invention, the hood 36 comprises a double-walled hollow shell which includes an outer conically shaped wall 104 and an inner similarly shaped wall 106, which walls are spaced apart as shown to provide an annular conical chamber 108 therebetween. The upper end of inner wall terminates at duct 100. The upper end of chamber 108 is closed by an end wall 110 while its lower end is open to provide free communication with the interior of chamber 102. The upper end portion of outer wall 104 and, if desired, end wall 110, is provided with ports 112 to permit entrance of air therethrough into chamber 108 and consequently also into chamber 102. It will be apparent that when the fan 32 is operated, air will be drawn downwardly at relatively high velocity through the ports 112 and chambers 108 and 102, and then upwardly through the central interior of the hood 36 into duct 100, following paths as diagrammetically indicated by arrows in FIG. 2.

Light particles in the chamber 102 and hood 36 will become entrained in the high velocity air stream and will thus be removed, while the remainder of the materials will drop down toward the bottom of the chamber 102.

In further accordance with this invention, moisture is removed from the material being deposited in the chamber 102. This is achieved by providing the hood 36 with coils or elements which perform a drying function. On the opposite sides of the inner wall 106 of the hood are disposed coils 114 and 116 of tubing which is adapted to be filled with a drying medium such as steam or hot water in the case of heat drying, or a refrigerant such as Freon in the case of cold drying. The coils 114 and 116 are connected at opposite ends by suitable pipes 118 (FIG. 1) to a source 120 of the drying medium whereby the medium may be circulated through the coils as desired.

It will be apparent that the coil 114 and wall 106 will radiate heat or cold downwardly into the chamber 102 to effect a desired drying of the material. This will provide more effective removal of small particles from the mass of material in the chamber.

Since it has been found that the air which enters the hood through the ports 112 often contains substantial amounts of moisture, the coil 116 and an additional coil 118 on the inner surface of outer wall 104 are provided to remove this moisture from the air before it progresses into the chamber 102. The coils 114, 116 and 118 are all preferably located adjacent a respective wall surface so that heating, for example, of a wall will cause additional radiation of the heat into the chamber being heated. However, the coils may be otherwise disposed if desired. For example, the coils 116 and 118 may be spaced in any selected array arrangement within the chamber 108 so that air passing through the chamber will necessarily pass over surfaces of the coils and consequently will be dried in that manner.

While the hood 36 is shown as being separate from the device 24 and secured thereto as by bolt-connected abutting flanges 120–122, it may comprise a part of the device structure, if desired. As shown in FIG. 3, the hood 28 need not necessarily be mounted at the top of the device but may be otherwise located so as to withdraw particle-laden air into duct 30. For example, the shredder 12 has connected to it one end of a conveyor 22 which includes a housing or duct 26 which encloses the conveyor. Collecting hood 28 is located in the area where housing 26 joins the shredder and thus communicates with the interiors of both the duct and shredder so that light particles dislodged or generated by shredder action will be removed in this area. Hood 28 may have a somewhat different exterior appearance but is constructed similar to hood 36, as described.

Referring to FIG. 4, the coils for accomplishing the drying function may comprise spaced square or annular rings which are disposed closely adjacent one another. In cross-section each ring 130–132 is substantially triangular or teardrop in shape, with the base of the triangle being disposed away from the adjacent wall surface. Thus, the bases of the triangles of the rings are aligned to form a conical surface over which the air flows, as shown by arrows in FIG. 4, which conical surface is broken at systematic intervals by the interstices between rings. Such interstices or spaces are preferably of a size only sufficient to permit water to pass through. For example, in an array comprised of rings having a base width of about 1¼ inches, the spacing may be about 0.025 inch. Such dimensions may be varied considerably, however.

Thus, as air proceeds downwardly through the outer chamber 108 of the hood it will move over the base surfaces of the rings 130 and consequently across the spaces between rings. Water in the air thus will be forced through the spaces by venturi action and will run down the adjacent surface of wall 106 to eventually be collected and removed by a trough 140 at the lower end of the wall. Thus air eventually reaching the interior of the collecting device will be substantially drier than when it entered the hood.

The elements 132 on the inside of wall 106 likewise may have the same Coanda teardrop or triangular shape so as to remove moisture in the air which is being drawn upwardly through the collector hood 36 into the duct 100.

It is to be understood that although the triangular Coanda elements 130 and 132 may be solid rings, they may each comprise a continuous coil of hollow triangular-shaped piping, if desired, so that a selected drying medium may be made to pass through the coils to provide supplemental or combination drying, thus considerably enhancing drying capabilities of the apparatus.

The rings or coils may be mounted in any selected array formation on the wall 106 as by vertical bars 142 whereby they will be retained in preassembled relation and properly spaced from the adjacent surface of the wall.

It will be apparent from the foregoing that all of the objects and advantages of this invention have been achieved in the novel collector hood with drying capabilities as described. However, it will be apparent that various changes and modifications in the structures shown and described may be made by those skilled in the art without departing from the spirit of the invention as expressed in the accompanying claims. Therefore, all matter shown and described is to be interpreted as illustrative and not in a limiting sense.

What is claimed is:

1. A material handling system comprising a chamber, means for directing material into said chamber, a collector hood mounted at the top of said chamber and having primary and second compartments both having their interiors in direct communication with the interior of said chamber, said second compartment encircling at least a major portion of the primary compartment, air inlet aperture means in said second compartment, duct means connected with said primary compartment, and fan means for creating an air stream flowing first into said second compartment through the air inlet aperture means, then into said chamber, and then into said primary compartment and duct means.

2. A material handling system as set forth in claim 1 wherein said primary compartment is substantially conical in shape, and said duct means is connected to the peak portion of the conical primary compartment.

3. A material handling system as set forth in claim 2 wherein said chamber comprises a portion of a storage tank.

4. A material handling system as set forth in claim 2 wherein said chamber comprises a portion of a shredder-conveyor apparatus.

5. A material handling system as set forth in claim 2 wherein said chamber comprises a portion of an enclosed conveyor apparatus.

6. A material handling system comprising a chamber, means for directing material into said chamber, a collector hood mounted at the top of said chamber and having primary and second compartments both having their interiors in direct communication with the interior of said chamber, said second compartment encircling said primary compartment, air inlet aperture means in said second compartment, duct means connected with said primary compartment, fan means for creating an air stream flowing first into said second compartment through the air inlet aperture means, then into said chamber, and then into said primary compartment and duct means, and drying means carried by said collector hood for drying material in said chamber and comprising ringlike drying elements mounted in said primary compartment.

7. A materials handling system as set forth in claim 6 wherein said drying elements are further disposed in said second compartment.

8. A materials handling system as set forth in claim 6 wherein said drying elements comprise an array of Coanda-shaped members.

9. In a material handling system which includes a chamber and means for directing material into said chamber, a collector hood adapted for mounting on said chamber, said hood having a primary compartment and a second compartment encircling the primary compartment, both compartments having their interiors in communication with the interior of the chamber, air inlet aperture means in said second compartment, exhaust means connected with said primary compartment, and means for creating an air stream flowing first into said second compartment through the air inlet aperture means, then into said chamber, and then through said primary compartment to the duct means.

10. In a system as set forth in claim 9, said hood further including drying means for drying material in said chamber.

11. The hood set forth in claim 10 wherein said drying means is located in said second compartment.

* * * * *